US007967481B2

(12) United States Patent
Seo

(10) Patent No.: US 7,967,481 B2
(45) Date of Patent: Jun. 28, 2011

(54) ADJUSTABLE RECESSED LIGHT FIXTURE

(75) Inventor: Ai-Sook Seo, Nonsan (KR)

(73) Assignee: Blix Lighting, Kyunggido (KR)

( * ) Notice: Subject to any disclaimer, the term of this patent is extended or adjusted under 35 U.S.C. 154(b) by 531 days.

(21) Appl. No.: 12/049,754

(22) Filed: Mar. 17, 2008

(65) Prior Publication Data

US 2009/0231862 A1 Sep. 17, 2009

(51) Int. Cl.
*F21V 17/08* (2006.01)

(52) U.S. Cl. ..... 362/366; 362/365; 362/148

(58) Field of Classification Search ..... 362/365, 362/364, 147, 148, 366, 427, 418, 285, 430
See application file for complete search history.

(56) References Cited

U.S. PATENT DOCUMENTS

| | | | | |
|---|---|---|---|---|
| 4,232,361 | A | 11/1980 | Kelsall | |
| 4,293,895 | A | 10/1981 | Kristofek | |
| 4,459,648 | A | 7/1984 | Ullman | |
| 4,972,339 | A | 11/1990 | Gabrius | |
| 5,073,845 | A | 12/1991 | Aubrey | |
| 5,145,249 | A | 9/1992 | Bruckner | |
| 5,505,419 | A | 4/1996 | Gabrius | |
| 5,548,499 | A | 8/1996 | Zadeh | |
| 5,580,158 | A | 12/1996 | Aubrey et al. | |
| 5,609,413 | A | 3/1997 | Lecluze | |
| 5,857,766 | A | 1/1999 | Sieczkowski | |
| 5,941,625 | A | 8/1999 | Morand | |
| 5,957,574 | A * | 9/1999 | Hentz et al. | 362/365 |
| 6,004,011 | A | 12/1999 | Sieczkowski | |
| 6,082,878 | A | 7/2000 | Doubek et al. | |
| 6,089,732 | A * | 7/2000 | Wright et al. | 362/364 |
| 6,554,458 | B1 | 4/2003 | Benghozi | |
| 6,827,471 | B1 | 12/2004 | Benghozi | |
| 6,896,394 | B2 | 5/2005 | Houle | |
| 7,325,948 | B2 | 2/2008 | Kay | |
| 2002/0089851 | A1 | 7/2002 | Jamison | |
| 2006/0109660 | A1 | 5/2006 | Wolf et al. | |
| 2008/0068847 | A1 | 3/2008 | Bedard | |

* cited by examiner

*Primary Examiner* — Bao Q Truong
(74) *Attorney, Agent, or Firm* — K&L Gates LLP

(57) ABSTRACT

A recessed light fixture includes a housing or can, a junction box, a protective flexible wire conduit connected to the junction box and the housing, and an adjustment assembly adjustably and detachably connecting the housing to the junction box. The adjustment assembly includes a first bracket connected to the housing and a second bracket connected to the junction box. The second bracket is slidably and detachably connected to the first bracket.

22 Claims, 8 Drawing Sheets

ADJUSTABLE RECESSED LIGHT FIXTURE

BACKGROUND

Recessed lights have become increasingly popular for use in both commercial and residential buildings and other structures. Recessed light fixtures are typically installed or mounted between ceiling joists or suspended ceiling support members. When installed, a major portion of the fixture is located in the ceiling and hidden above the visible ceiling line. Thus, the fixtures are unobtrusive but still provide efficient illumination within an interior space. Recessed light fixtures are available in various sizes and can be used in various arrangements.

Recessed light fixtures may be installed in new construction or may be retrofit in existing ceilings. "New work" fixtures are used primarily in new construction applications when the ceiling joists are exposed and easily accessible. "Remodel" type fixtures are conventionally used in remodeling applications when the ceiling is already covered by drywall or plaster and lath.

Conventionally, new work recessed light fixtures include a fixture frame or pan which is mounted or secured between the ceiling joists or the suspended ceiling members. The frame typically has a rectangular or square shape. A junction box is disposed on the frame and connected to an electrical power source. The frame further includes a housing which contains the light source or lamp. The junction box and the housing are fixed on the fixture frame. A flexible wire conduit extends from the junction box to the housing to provide power to the lamp contained therein. Hanger bars extend along opposed edges of the fixture frame to connect the frame to the joists or suspended ceiling members.

Conventional new work light fixtures typically include at least four hanger bars, each of which must be attached to a joist or T-bar to support the frame. Accordingly, installing new work light fixtures can be difficult and cumbersome. In general, new work light fixtures cannot be installed once a ceiling is in place because their frame and hanger bar assemblies cause them to be them larger than the openings in the ceilings.

Remodel-type light fixtures are available for installing recessed light fixtures after the installation of the ceiling. Remodel light fixtures generally do not include a fixture frame or hanger bars. In remodel-type fixtures, the junction box and the housing are typically connected by a bracket. A flexible wire conduit extends from the junction box to the housing. To install a remodel-type light fixture, the installer cuts a specified diameter hole into the ceiling. The fixture is inserted into the hole from below the ceiling line and locked into position within the hole by one or more mounting clips that extend from the housing. The mounting clips are designed to trap the ceiling substrate material between a circumferential ring on the housing at the ceiling line and the top side of the substrate. The weight of the light fixture is thus supported on the ceiling instead of being supported by the joists through hanger bars, such as in a new work fixture.

One disadvantage associated with known new work light fixtures is that they typically include bulky frame assemblies, and the junction box and the housing are in a fixed arrangement relative to each other on the frame. Due to the configuration, size, and weight of such frame assemblies, the cost of packaging, storing, and shipping light fixtures of this type is substantial.

Prior to shipping, each light fixture must be individually packaged in a box that is large enough to contain the light fixture. Making boxes that are large enough to contain these types of light fixtures requires more raw materials, which results in a greater expenditure of money, energy, and time.

The process of shipping the light fixtures from the original manufacturer to the final retailer typically involves several steps, particularly when the light fixtures are manufactured overseas. First, the light fixtures are transported from the manufacturer's factory to a shipping center on trucks. At the shipping center, the light fixtures are loaded onto boats to be shipped to distributors. The distributors then ship the fixtures to the retailers.

Due to the size of the light fixtures and the boxes in which they are contained, fewer of these light fixtures can fit into factory boxes or crates for shipping. Therefore, the trucks and/or boats which transport the light fixtures at each point in the shipping process can accommodate fewer light fixtures at a time. For large shipments, a greater number of trucks and boats are required to carry all of the light fixtures, or the trucks and boats have to make more trips to transport all of the light fixtures. This requires a substantial amount of fuel and energy and leads to increased costs and longer lead times.

Presently, installers must use new work fixtures for new construction applications (i.e., before installation of the ceiling or in cases where the ceiling joists are exposed or accessible) and remodel type fixtures for retrofit applications (i.e., when the ceiling is in place). Thus, installers have to make sure they have the correct type of light fixture for a particular job. This can present certain disadvantages for the installer because, if the installer is not prepared with the correct type of light fixture for the installation, it will take additional time to obtain an appropriate light fixture.

Moreover, since each different type of installation requires a specific light fixture, retailers must stock new work light fixtures as well as remodel light fixtures in their stores. This can present stocking issues for retailers. It can be difficult to determine how many of each type of light fixture to stock in their stores. Retailers must spend more time analyzing their inventory and their customers' needs to make sure they order accurate quantities of each type of light fixture. In addition, retailers must have sufficient space in their stores and/or warehouses for storing two different types of light fixtures.

Furthermore, since both new work and remodel-type light fixtures must be packaged and shipped from the manufacturer to the retailer, the expenses associated with packaging and shipping the light fixtures are magnified.

A need therefore exists to provide a recessed light fixture which can be used for both new construction and remodeling installations. Further, a need exists to provide a recessed light fixture which is compact and lightweight and which reduces the costs associated with manufacturing, packaging, shipping, and storing light fixtures.

SUMMARY

One embodiment of the present disclosure provides a recessed light fixture which includes a housing or can, a junction box, a protective flexible wire conduit connected to the junction box and the housing, and an adjustment assembly which adjustably and detachably connects the housing to the junction box. The adjustment assembly includes a first bracket connected to the housing and a second bracket connected to the junction box. The second bracket is slidably and detachably connected to the first bracket, such that in a first locked position, the junction box is closer to the housing than in a second locked position.

In one embodiment, the first bracket is slidably connected to the side wall of the housing. The second bracket includes a first end and a second end. The first end of the second bracket is connected to the junction box, and the second end of the second bracket is configured to be received by the first bracket, such that the first and second brackets are slidably engaged. The adjustment assembly further includes a locking mechanism, such as a fastener, which removably extends through the first and second brackets of the adjustment assembly to secure the first and second brackets of the adjustment assembly in a fixed or locked position relative to each other.

When the recessed light fixture is being used in a new construction installation, the junction box is mounted or secured to a structural member, such as a stud or joist, to secure the light fixture in the installation space. Once the junction box is secured to the joist, the length of adjustable assembly can be adjusted by either pulling apart or pushing together the first and second brackets. This enables an installer to adjust the position of the housing relative to the joist.

When the recessed light fixture of the present disclosure is employed in retro-fit or remodel applications, the first bracket and second bracket are detached from each other (i.e., the adjustment assembly is pulled apart). When the first and second brackets are detached, the junction box and the housing are no longer connected by the adjustment assembly. It should be appreciated, however, that the junction box and housing are still connected by the flexible wire conduit. To install the light fixture in the installation space, the junction box, which is connected to the first bracket, is inserted up and through a ceiling aperture. The housing, which is connected to the second bracket, is then inserted up and through the ceiling aperture and mounted to the ceiling by retaining clips or mounting clips which extend from the housing and engage the top surface of the ceiling.

Since the housing and junction box can be detached or disconnected from each other (i.e., the housing and junction box are not fixed on a supporting frame, such as in conventional light fixtures), the recessed light fixture can be arranged in a more compact configuration. More specifically, when the first and second brackets of the adjustment assembly are detached (i.e., the adjustment assembly does not connect the housing to the junction box), the junction box can be placed within the housing chamber. In this configuration, each individual light fixture can fit into a smaller packaging box. Therefore, the amount of raw materials, time, and energy required to package the light fixtures is reduced. Since the individual light fixtures are more compact, a larger quantity of the light fixtures can be contained in a single shipping container. As a result, fewer trucks, boats, or other vehicles are required to transport the light fixtures at each point in the shipping process. This saves time, fuel and energy. Accordingly, the light fixtures get from the manufacturer's factory to the final retailer quicker and more cost-effectively.

Furthermore, since the recessed light fixture of the present disclosure can be used in both new construction and remodel applications, this eliminates the need for manufacturing, packaging, and shipping two different types of light fixtures.

It is therefore an advantage of the present disclosure to provide a recessed light fixture which includes an adjustment assembly that adjustably connects the junction box to the housing.

Another advantage of the present disclosure is to provide a recessed light fixture which enables adjustment of the distance between the junction box and the housing.

Another advantage of the present disclosure is to provide a recessed light fixture which can be used for both new construction and retrofit or remodel installations.

Another advantage of the present disclosure is to provide a recessed lighting fixture that eliminates the need for bulky mounting frames and hanger bar assemblies.

Another advantage of the present disclosure is to provide a recessed lighting fixture that provides vertical adjustment to account for variable ceiling thickness and variable distances between the joists and the ceiling.

Another advantage of the present disclosure is to provide a recessed lighting fixture that is lightweight and compact.

Another advantage of the present disclosure is to provide a recessed lighting fixture which is volumetrically efficient for shipping purposes and thus reduces shipping costs.

Other objects, features and advantages of the present disclosure will be apparent from the following detailed disclosure, taken in conjunction with the accompanying sheets of drawings, wherein like numerals refer to like parts, elements, components, steps and processes.

DETAILED DESCRIPTION

Figure 1:
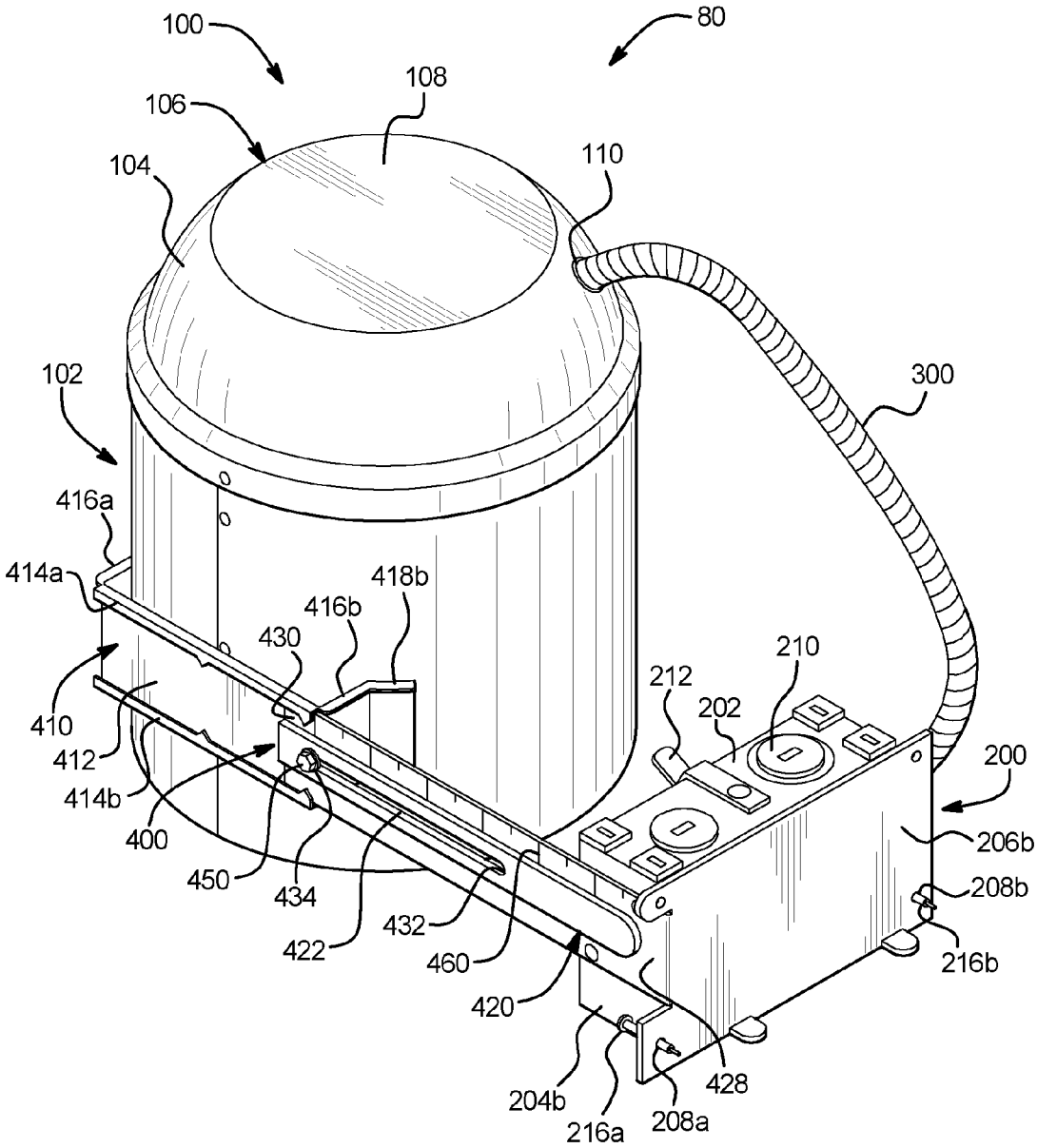
FIG. 1 is a perspective view of one embodiment of the recessed light fixture of the present disclosure illustrating the adjustment assembly holding the junction box at a first position relative to the housing.
Figure 2:
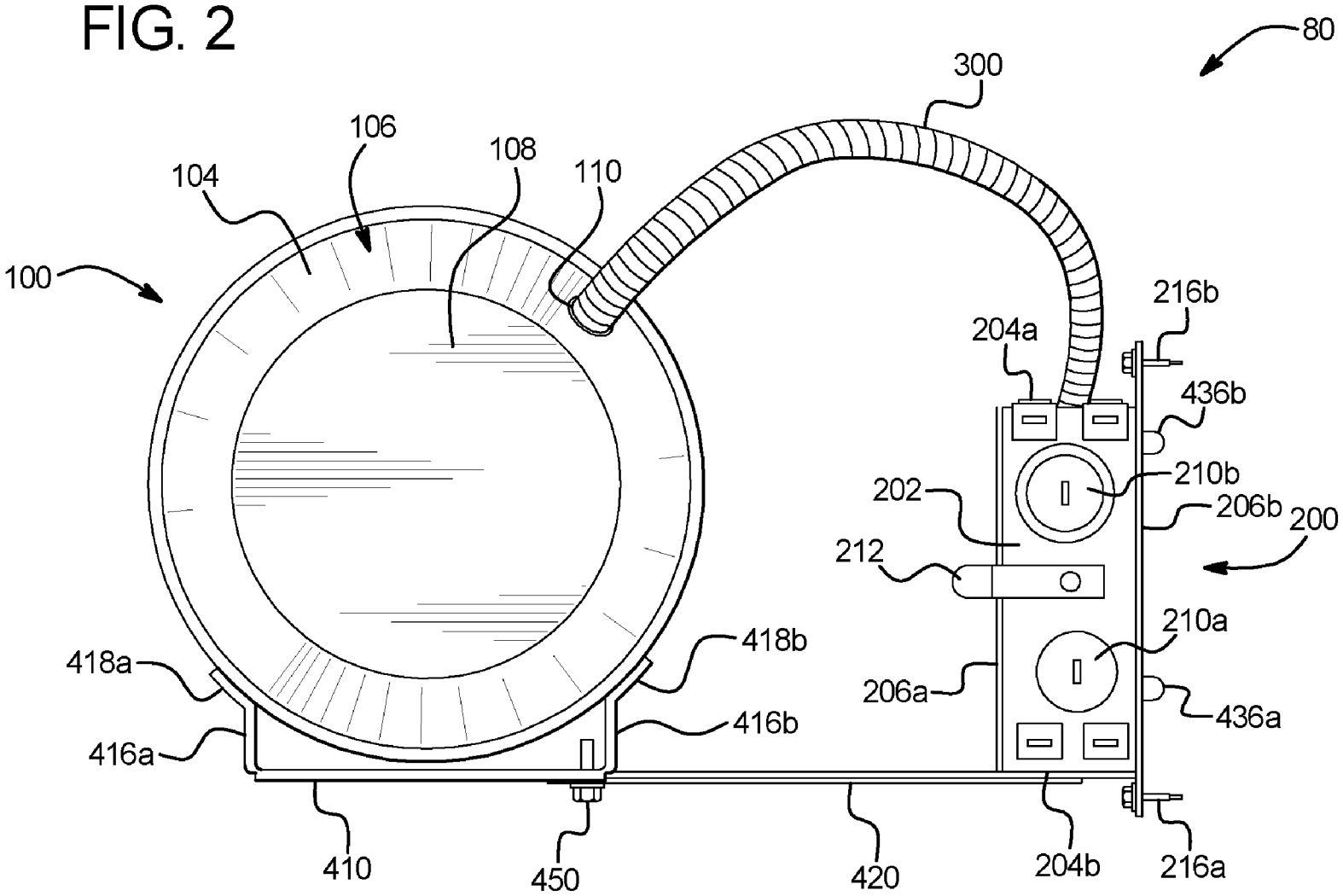
FIG. 2 is a top view of the embodiment of FIG. 1, wherein the junction box is located at the first position relative to the housing.
Figure 3:
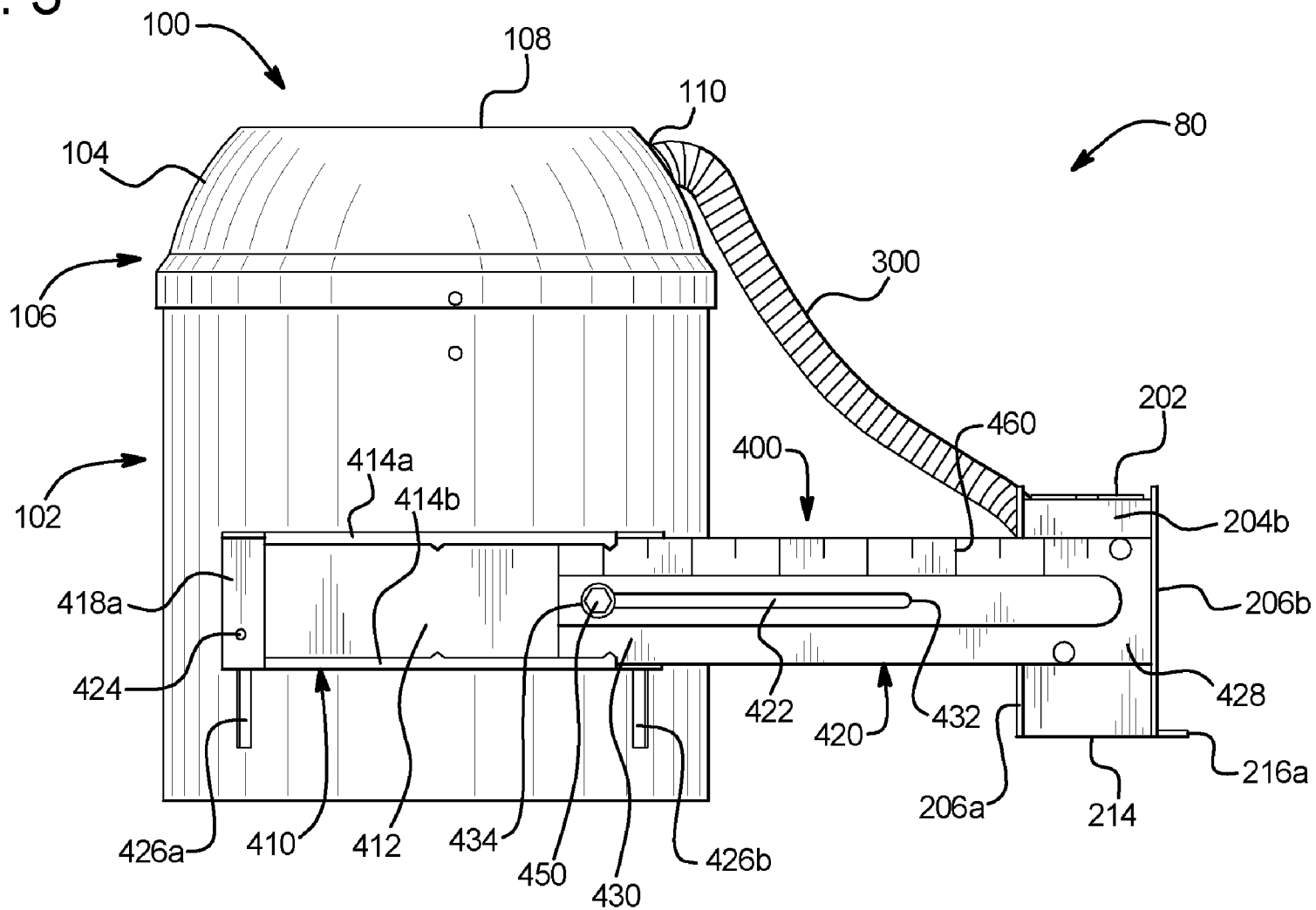
FIG. 3 is a front view of the embodiment of FIG. 1, wherein the junction box is located at the first position relative to the housing.
Figure 4:
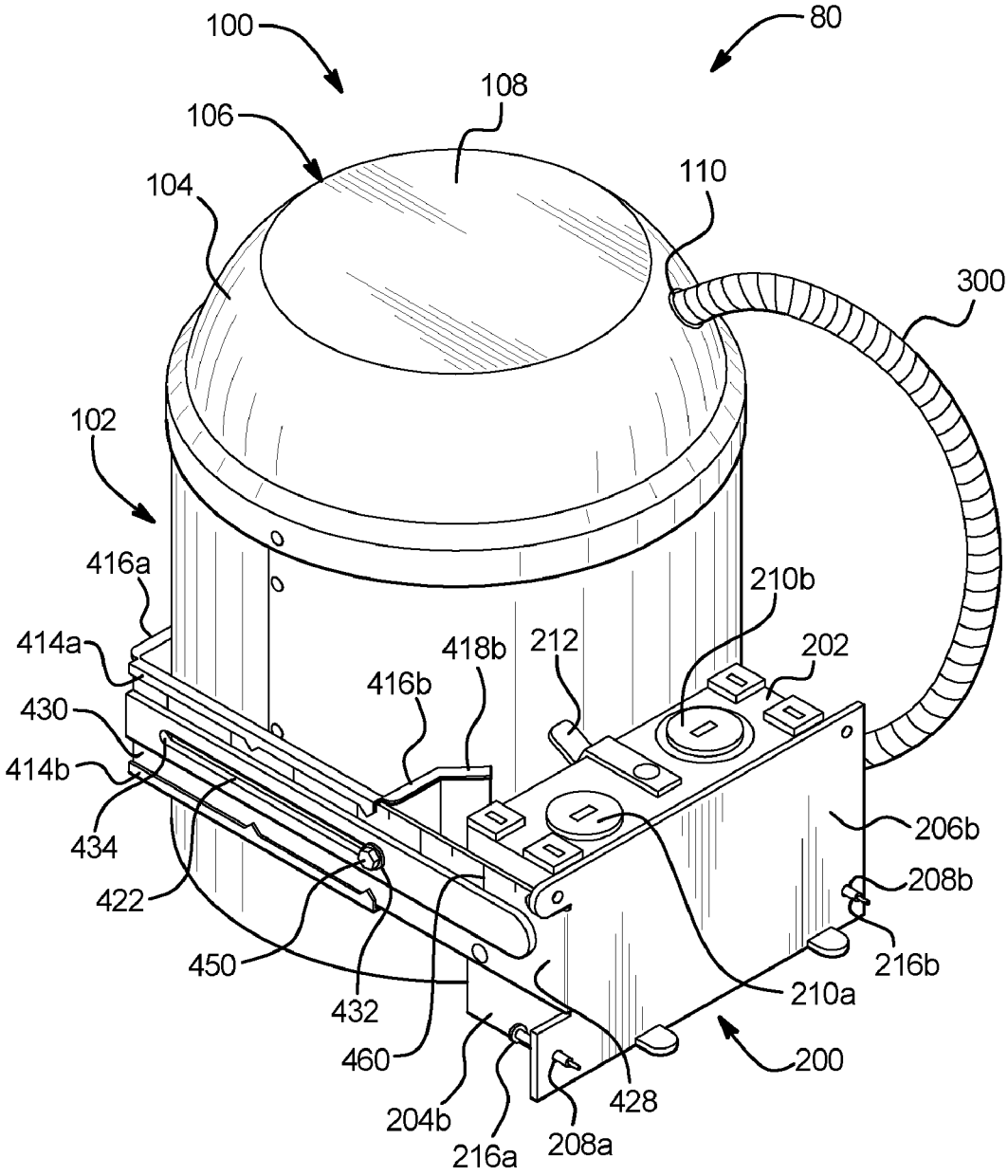
FIG. 4 is a perspective view of the embodiment of the recessed light fixture of FIG. 1, wherein the junction box is located at a second closer position to the housing.
Figure 5:
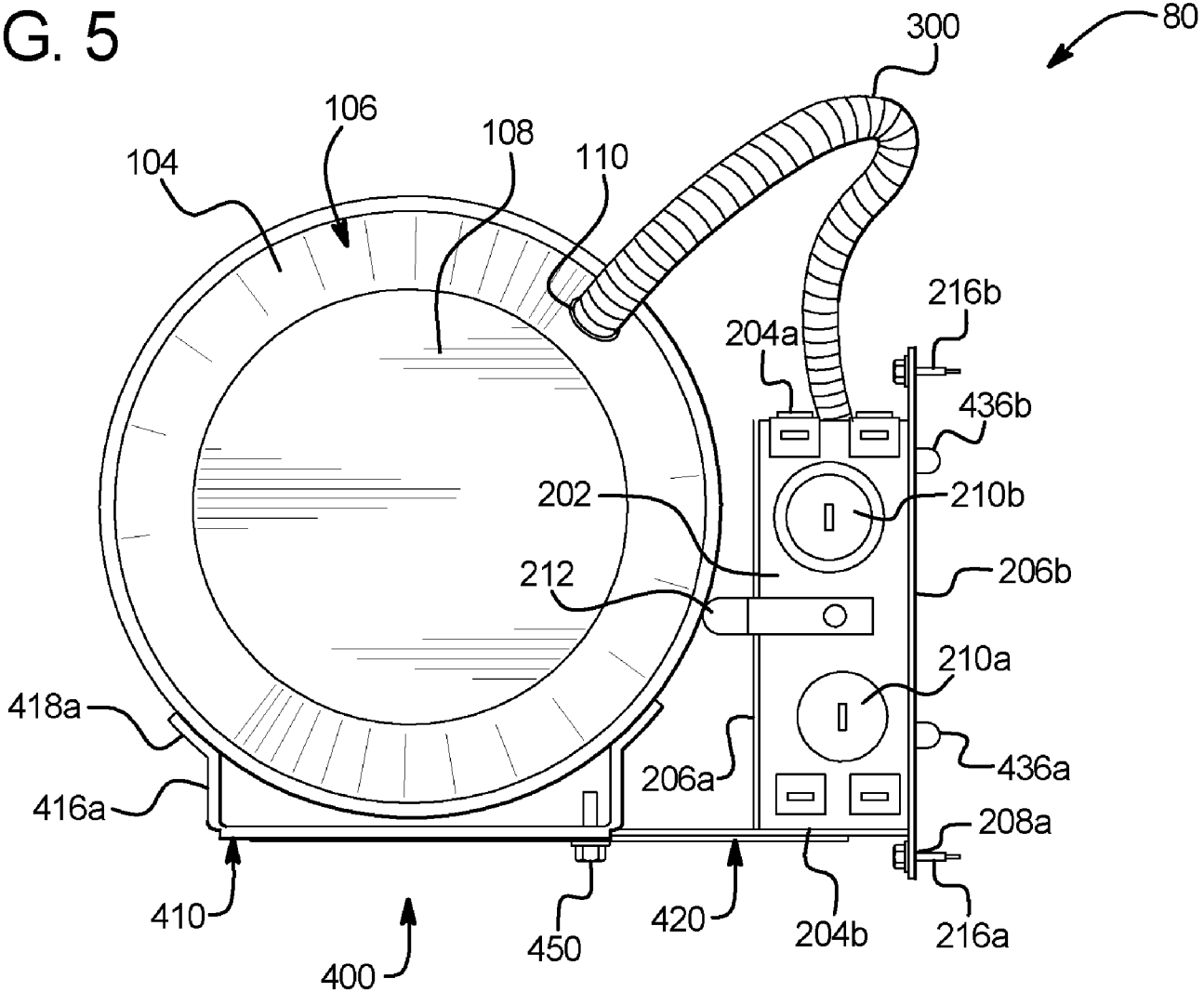
FIG. 5 is a top view of the embodiment of the recessed light fixture of FIG. 1, wherein the junction box is located at the second position relative to the housing.
Figure 6:
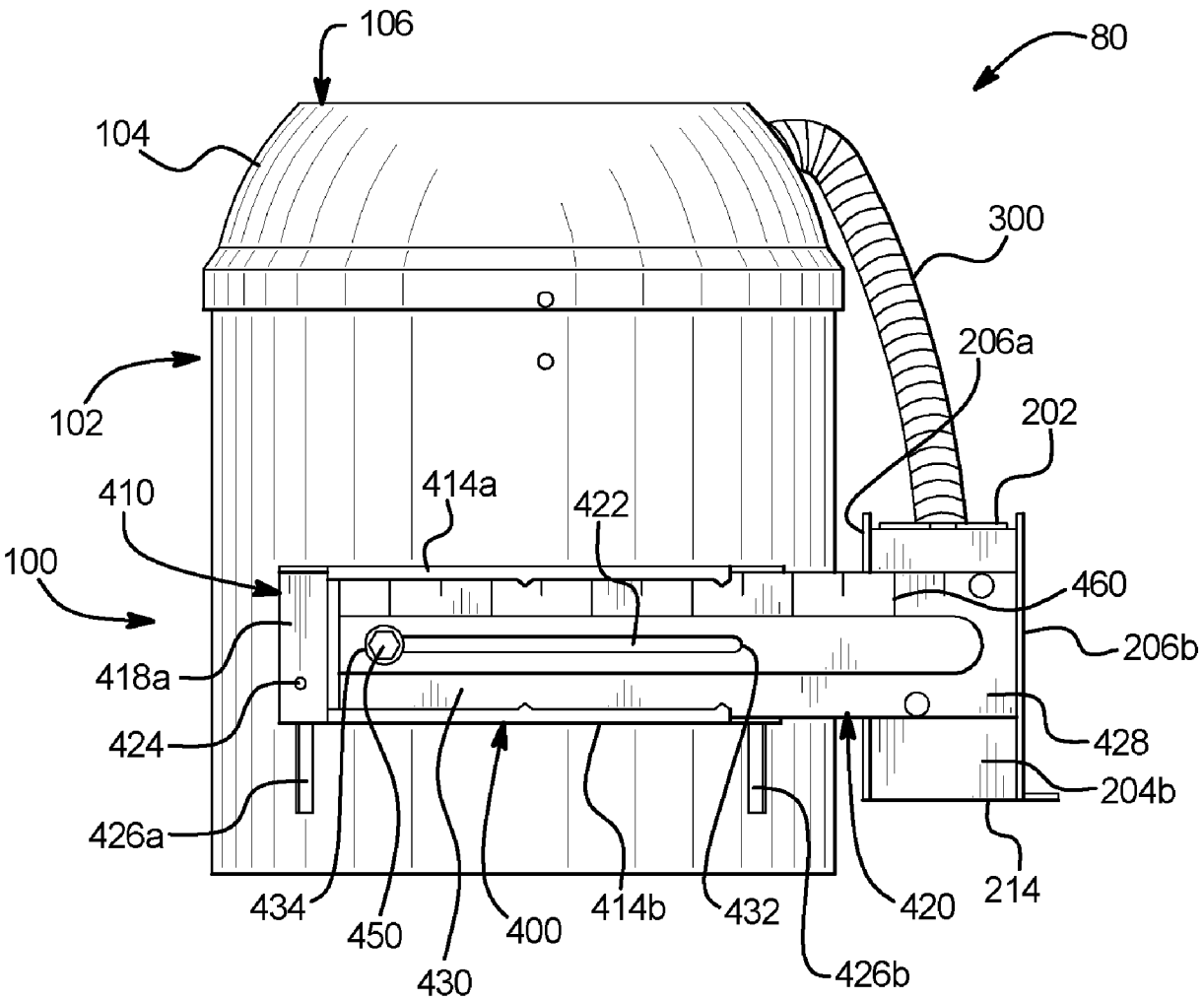
FIG. 6 is a front view of the embodiment of the recessed light fixture of FIG. 1, wherein the junction box is located at the second position relative to the housing.
Figure 7:
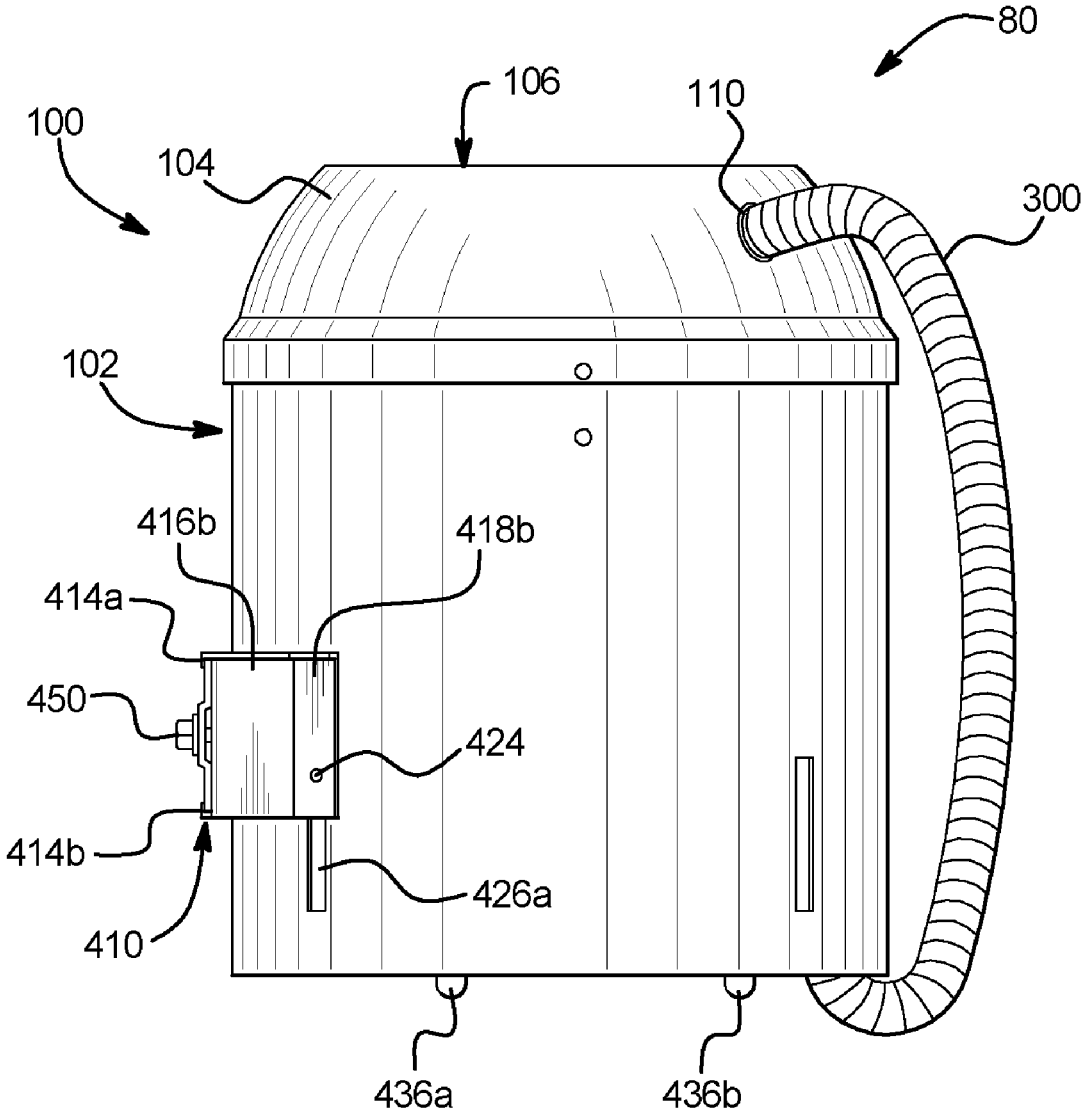
FIG. 7 is a front view of the recessed light fixture of the present disclosure, wherein the junction box is placed in the housing chamber for packaging, shipping, or storage.
Figure 8:
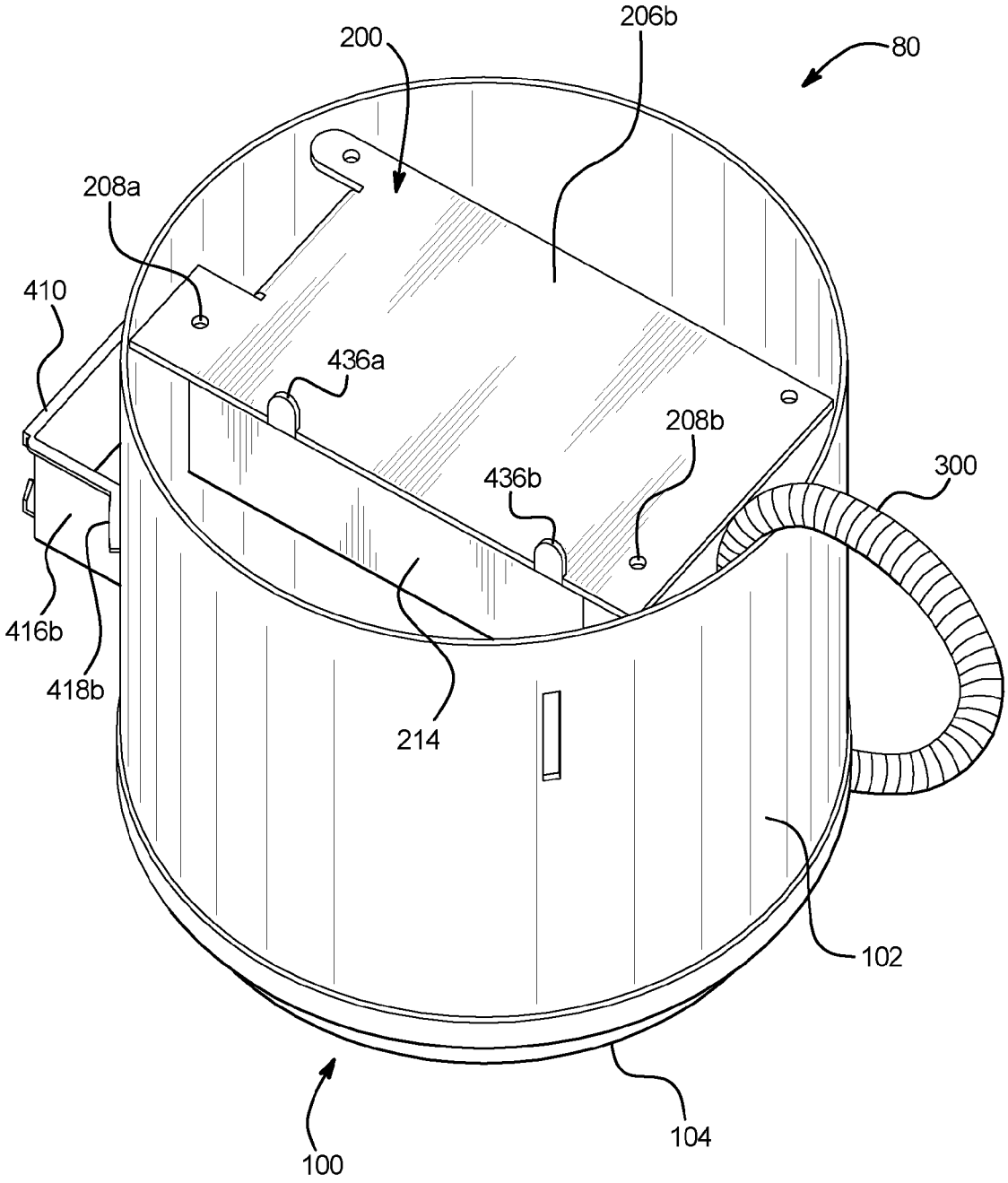
FIG. 8 is a perspective view of the recessed light fixture of the present disclosure, wherein the junction box is placed in the housing chamber for packaging, shipping, or storage.

Referring now to FIGS. 1, 2, and 3, one embodiment of the present disclosure provides a recessed light fixture 80 which includes a housing 100, a junction box 200, and an adjustment assembly 400 for adjustably and detachably connecting the housing 100 to the junction box 200. FIGS. 1, 2, and 3 illustrate the adjustment assembly 400 holding the junction box 200 in a first locked position relative to the housing 100. In FIGS. 4, 5, and 6, the adjustment assembly of the recessed light fixture is holding the junction box 200 at a second closer position relative to the housing 100. It should be appreciated that the adjustment assembly 400 is configured to enable holding the junction box 200 at multiple different positions relative to the housing 100, as discussed below. It should also be appreciated that the adjustment assembly 400 may be pulled apart, such that it no longer connects the housing 100 to the junction box 200. For example, as seen in FIGS. 7 and 8, the junction box 200 and the housing 100 are not connected by the adjustable assembly 400, and the junction box 200 is placed within the housing 100 for packaging, shipping, or storage.

In one embodiment, the housing 100 includes a side wall 102 and a cap 106 connected to an upper portion of the side wall 102 which defines an inner chamber. In the illustrated embodiment, the side wall 102 of the housing 100 is substantially cylindrical. It should be appreciated, however, that the housing may be any suitable shape, such as oval, rectangular, elliptical, or triangular. It should be also appreciated that the housing 100 may be of any size. For example, the housing 200 may have a 3" diameter, a 4" diameter, a 5" diameter, or any other suitable diameter. In one embodiment, the cap 106 includes an outer wall 104 and a flat upper wall 108. In one embodiment, the outer wall 104 slopes or curves inward. In another embodiment, the outer wall does not slope or curve and is substantially straight. A bottom portion of the housing 112 defines an opening to enclose a light source and to reflect downward light emitted by the light source. It should be appreciated that the opening defined by the bottom portion of the housing maybe any suitable shape, such as circular, oval, rectangular, or triangular.

In one embodiment, the housing 100 is configured to be centered on an axis that extends perpendicular to a ceiling in which the light fixture is mounted. A lamp holder (not shown) is mounted inside the housing chamber and suitably connected to the side wall 102. At least one lamp socket (not shown) is mounted on or supported by the lamp holder for receiving at least one light source, such as a lamp or bulb. The lamp socket forms a mechanical and an electrical connection to the bulb to retain the bulb in position and supply the bulb with power. In one embodiment, the lamp holder and lamp socket are centered on an axis that is coaxial with the axis on which the housing 100 is centered. It should be appreciated that the recessed light fixture 80 may hold any suitable type of lamp, including, for example, incandescent lamps, low voltage lamps, fluorescent lamps or other gas-filled lamps, and high intensity discharge (HID) lamps.

In one embodiment, an L-shaped plate (not shown) located in the housing chamber mounts or secures the lamp holder within the housing 100. A first segment of the L-shaped plate is placed adjacent to the inside of the side wall 102 within the chamber. The first segment defines an opening which is positioned adjacent to an opening defined by the side wall 102 of the housing. A fastener extends through the opening defined by the first segment and the opening defined by the side wall 102 to keep the plate securely positioned within and mounted to the housing 100. The second segment of the L-shaped plate is placed adjacent and connected to the lamp holder. The second segment of the L-shaped plate defines an opening for receiving the lamp socket which is supported by the lamp holder.

The housing 100 further defines an opening 110 for receiving a flexible wire conduit 300. The flexible wire conduit 300 connects the housing 100 to the junction box 200. As seen in FIG. 1, in one embodiment, the opening 110 for receiving the conduit 300 is located in the cap 106 of the housing 100.

The junction box 200 includes a top wall 202, a bottom wall 214 opposite the top wall 202, and opposed side walls 204*a* and 204*b*, extending between the top wall 202 and bottom wall 214. The junction box 200 defines an enclosure which functions as a receptacle for connecting a plurality of wires from an electrical power source to the lamp socket in the housing 100. The wires are connected to the lamp socket at one end and extend though the protective flexible conduit 300 into the junction box 200 at the other end.

The junction box top wall 202, bottom wall 214, and side walls 204*a* and 204*b* further define front and rear openings which are substantially rectangular or square in shape. Junction box doors 206*a* and 206*b* are disposed over the openings in order to close the junction box 200, according to applicable electrical codes. The junction box doors 206*a* and 206*b* are connected to the junction box 200 by at least one door aperture located in the bottom wall 214 of the junction box 200 and by at least one arm 212 which extends across the top wall 202. In one embodiment, the junction box doors 206*a* and 206*b* have tabs 436*a* and 436*b* extending into the apertures of the junction box bottom wall 214 to retain a bottom edge of the doors 206*a* and 206*b*. The top edge of each door 206*a* and 206*b* is retained against the junction box top wall 202 by the arm 212 which extends across the junction box top wall 202.

One or more of the side walls 204*a* and 204*b* and top wall 202 of the junction box includes a plurality of knockout structures 210*a* and 210*b*. The knockout structures 210*a* and 210*b* provide a plurality of wire paths where electric cables, including, but not limited to, Romex, BX or other appropriate factory assembled flexible wires, are intended to be inserted from the exterior of the junction box 200 to the interior thereof for providing proper electrical connections, as is known in the art.

The recessed light fixture 80 further includes an adjustable assembly 400 which adjustably and detachably connects the junction box 200 to the housing 100. It should be appreciated that the protective conduit 300 provides a flexible connection between the housing 100 and the junction box 200. This permits adjustment of the distance between the junction box 200 and the housing 100.

In one embodiment, the adjustment assembly 400 includes a first bracket 410 and a second bracket 420. In one embodiment, the first bracket 410 is connected to the side wall 102 of the housing 100, and the second bracket 420 is connected to the junction box 200. The second bracket 420 is adjustably and detachably connected to the first bracket 410 such that in a first locked position, the junction box is farther away from to the housing than in a second locked position. In one embodiment, the second bracket 420 is slidably receivable in the first bracket 410. In an alternative embodiment, the first bracket 410 is slidably receivable in the second bracket 420. It should be appreciated that the arrangement of the first and second brackets 410 and 420 of the adjustment assembly 400 can be reversed.

In one embodiment, the first bracket 410 is generally C-shaped, having a top flat portion 412 joined to a pair of downwardly extending lateral legs 416*a* and 416*b*. In one embodiment, the top flat portion 412 of the first bracket 410 includes a slot defined by a base and two flanges or lips 414*a* and 414*b*. The slot is configured to receive the second bracket 420. Each of lateral legs 416*a* and 416*b* includes an end portion 418*a* and 418*b* which bends outwardly away from the opposite leg and provides a surface which defines at least one opening 424.

In one embodiment, the housing 100 includes a plurality of openings 426*a* and 426*b* defined by the side wall 102 to enable the first bracket 410 to be connected to the housing 100. In one embodiment, the end portions 418*a* and 418*b* of the lateral legs 416*a* and 416*b* are positioned adjacent to the side wall 102 of the housing 100, such that the opening defined by each of the end portions 418*a* and 418*b* overlaps with one of the openings 426*a* and 426*b* defined by the side wall 102. Each of the end portions 418*a* and 418*b* is secured to the side wall 102 by inserting a fastener which extends through the opening 426*a* and 426*b* defined by the side wall 102 and the corresponding opening defined by that end portion and tightening the fastener so that the first bracket 410 and housing 100 are locked in position relative to each other.

In one such embodiment, the openings 426*a* and 426*b* defined by the side wall 102 comprise elongated slots which extend vertically along the side wall 102. In such an embodiment, the openings 426*a* and 426*b* enable the first bracket 410 to be connected to the side wall 102 at any point within the vertical slots. Upper and lower limits of the elongated vertical slots limit where the first bracket 410 can be connected to the side wall 102 of the housing 100. This provides vertical adjustment of the entire adjustable assembly and the junction box to account for variable ceiling thickness and variable distances between the joists and the ceiling. Once the first bracket 410 is positioned at a desired location within the elongated slots, a fastener is inserted though each opening 424 defined by the end portions 418*a* and 418*b* of the lateral legs 416*a* and 416*b* and tightened to removably secure the first bracket 410 in place relative to the housing 100. It should be appreciated that various methods for securing or fastening the first bracket 410 to the housing 100 may be used.

In one embodiment, the second bracket 420 of the adjustment assembly 400 includes a first end 428 and a second end 430. In one embodiment, the first end 428 of the second bracket 420 is connected to the junction box 200. The second end 430 of the second bracket 420 is configured to be slidably received by the slot of the first bracket 410. The first and second brackets 410 and 420 are thus slidably engaged, such that they can slide along a horizontal plane relative to each other when the adjustment assembly 400 is in an unlocked or unsecured position. This enables an installer to adjust the distance between the junction box 200 and the housing 100.

In one embodiment, the second bracket 420 defines an elongated opening 422 which extends horizontally through the second bracket 410. The elongated opening 422 includes a first end and a second end 432 and 434, respectively. In one embodiment, the first end 432 is the end of the elongated opening 422 which is closest to the junction box 200, and the second end 434 is the other end of the elongated opening 422. The first and second ends 432 and 434 limit the sliding motion of the first and second brackets relative to each other. Further, the first end 432 and the second end 434 of the elongated opening 422 define the longest distance and shortest distance, respectively, that the housing 100 and junction box 200 can have between them. In various embodiments, one or both of the first and second brackets 410 and 420 include a plurality of graduations 460 to enable measuring the precise distance between the junction box 200 and housing 100.

The adjustment assembly further includes a locking mechanism or fastener 450, such as a threaded bolt, which removably secures the first and second brackets. The fastener 450 extends through the elongated slot 422 defined by the second bracket 420 and into an opening defined by the flat upper portion of the C-shaped first bracket 410. The fastener 450 is tightened to prevent sliding of the first and second brackets 410 and 420 once the light fixture is ready to be installed.

As seen in FIGS. 1, 2, and 3, the fastener 450 is located at the second end 434 of the elongated opening 422 defined by the second bracket 420. Therefore, the junction box 200 is in a locked position relative to the housing 100 which has the largest distance between the junction box 200 and the housing 100 permitted by the elongated opening 422 defined by the second bracket 420.

Referring now to FIGS. 4, 5, and 6, the recessed light fixture 80 of the present disclosure is illustrated where the adjustment assembly 400 is holding the junction box 200 in a second locked position relative to the housing 100. More specifically, as seen in FIG. 4, the fastener 450 is positioned at the first end 432 of the elongated opening 422 defined by the second bracket 420 (i.e., the end closest to the junction box). Thus, the junction box 200 is in a locked position relative to the housing 100 which has the shortest possible distance between the junction box 200 and the housing 100. It should be appreciated that, since the first and second brackets 410 and 420 are in sliding engagement and can be locked or secured in multiple different positions, the adjustment assembly 400 enables the junction box 200 to be held at a number of distances from the housing 100.

In one embodiment, one of the junction box doors 206*b* defines a plurality of openings 208*a* and 208*b*. When the recessed light fixture of the present disclosure is being used in a new construction installation (i.e., when the ceiling joists are exposed and easily accessible), fasteners 216*a* and 216*b* are inserted into each of the openings 208*a* and 208*b* of the junction box 200 to secure the junction box 200 to a structural member, such as a stud or joist. As such, only one mounting point (i.e., on the joist) is required to adequately secure the light fixture in the installation space. Therefore, in addition to containing electrical wiring and connectors, the junction box 200 functions to support the recessed light fixture, and thus eliminates the need for hanger bars. Once the junction box 200 is secured to a joist, the length of adjustable assembly 400 can be adjusted by either pulling apart or pushing together the first and second brackets 410 and 420. This enables an installer to adjust the position of the housing relative to the joist. In this manner, the installer can position the housing at any desired distance from the joist and can, therefore, align the housing with a ceiling aperture or the desired location for the ceiling aperture.

In addition to new construction applications, the recessed light fixture 80 can also be employed in retro-fit or remodel applications (i.e., when a ceiling is already in place). In one embodiment, for retro-fit applications, the first and second bracket 410 and 420 are detached from each other, such that the junction box 200 and the housing 100 are not connected by the adjustment assembly 400. It should be appreciated, however, that the housing 100 and the junction box 200 are still be connected by the flexible conduit 300. Once the first and second brackets 410 and 420 are separated from each other, the junction box 200, which is connected to the first bracket 410, is inserted up and through a ceiling aperture. The housing 100, which is connected to the second bracket 420, is then inserted up and through the ceiling aperture and mounted to the ceiling by retaining clips or mounting clips (not shown) which extend from the housing 100 and engage the upper surface of the ceiling.

It should therefore be appreciated that the recessed light fixture of the present disclosure can be used for both new construction and retrofit applications. This saves end users time because they do not have to worry about having a specific type of light fixture for an installation job. This also provides increased manufacturing efficiency by reducing the production quantities, which results in reduced inventory and simplified production procedures and processes. Furthermore, providing a recessed light fixture which can be used in both new construction and remodel installations eliminates the need for retailers to determine how many of each different type of light fixture to stock in their stores.

Referring now to FIGS. 7 and 8, the recessed light fixture is illustrated where the junction box 200 and housing 100 are not connected by the adjustment assembly 400. The junction box 200 and the housing 100 are detached from each other. The junction box 200 is held within the housing chamber. In this configuration, the recessed light fixture is more compact.

Thus, a larger quantity of the light fixtures can be packaged in a single shipping container. This reduces the total expense of packaging, storing, and shipping the recessed light fixtures.

In one embodiment, the recessed light fixture of the present disclosure is made of steel. In various alternative embodiments, the recessed light fixture may be made of aluminum, plastic, or any other suitable construction material or combination of construction materials.

It should be appreciated that each of the parts of the recessed light fixture of the present disclosure can be of any suitable size, shape, or configuration.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A recessed light fixture comprising:

a housing including a side wall which defines a chamber;

a junction box;

a flexible conduit connected to the junction box and to the housing; and an adjustment assembly adjustably and detachably connecting the housing and the junction box, said adjustment assembly including:

(i) a first bracket connected to the side wall of the housing, and (ii) a second bracket connected to the junction box, said second bracket adjustably and detachably connected to said first bracket such that the first bracket and the second bracket are configured to move relative to each other and in a first locked position, the junction box is closer to the housing than in a second, different locked position.

2. The recessed light fixture of claim 1, wherein the housing includes: (i) a lamp holder connected to the side wall and mounted inside the chamber, and (ii) a lamp socket mounted within the chamber and supported by the lamp holder, wherein said lamp socket is configured to removably receive a light source.

3. The recessed light fixture of claim 2, wherein a plurality of wires extend through the flexible conduit and connect to the lamp socket at one end and extend into the junction box at another end.

4. The recessed light fixture of claim 1, wherein said adjustment assembly includes a fastener configured to removably secure the first bracket to the second bracket in the locked position.

5. The recessed light fixture of claim 1, wherein the first bracket is slidably connected to the side wall of the housing.

6. The recessed light fixture of claim 1, wherein the first bracket is slidably receivable in the second bracket.

7. The recessed light fixture of claim 1, wherein the second bracket is slidably receivable in the first bracket.

8. The recessed light fixture of claim 1, wherein the side wall is substantially cylindrical.

9. The recessed light fixture of claim 1, wherein at least one of said first and second brackets includes a plurality of graduations.

10. A recessed light fixture comprising:

a housing;

a junction box; and an adjustment assembly configured to adjustably and detachably connect the housing and the junction box, said adjustment assembly including:

(i) a first bracket connected to the housing, (ii) a second bracket connected to the junction box, wherein said second bracket and said first bracket are slidably and detachably connected to each other, such that the first bracket and the second bracket are configured to move relative to each other, and (iii) a locking mechanism configured to removably secure the first bracket to the second bracket in a plurality of different positions, such that in a first secured position, the junction box is closer to the housing than in a second, different secured position.

11. The recessed light fixture of claim 10, wherein said housing includes a side wall.

12. The recessed light fixture of claim 11, wherein the first bracket is connected to the side wall of the housing.

13. The recessed light fixture of claim 12, wherein the first bracket is slidably connected to the side wall of the housing.

14. The recessed light fixture of claim 10, wherein the first bracket is slidably receivable in the second bracket.

15. The recessed light fixture of claim 10, wherein the second bracket is slidably receivable in the first bracket.

16. The recessed light fixture of claim 10, wherein at least one of said first and second brackets includes a plurality of graduations.

17. A recessed light fixture comprising:

a housing including:

(i) a side wall which defines a chamber, (ii) a lamp holder connected to the side wall and mounted within the chamber, and (iii) a lamp socket supported by the lamp holder and configured to removably receive a light source;

a junction box;

a flexible conduit connected to the junction box and to the housing;

a plurality of wires extending through the flexible conduit and connected to the lamp socket at one end and extending into the junction box at another end; and an adjustment assembly adjustably and detachably connecting the housing and the junction box, said adjustment assembly including:

a first bracket slidably connected to the side wall of the housing, and (ii) a second bracket connected to the junction box, said second bracket adjustably and detachably connected to said first bracket such that the first bracket and the second bracket are configured to move relative to each other and in a first locked position, the junction box is closer to the housing than in a second, different locked position.

18. The recessed light fixture of claim 17, wherein said adjustment assembly includes a fastener configured to removably secure the first bracket to the second bracket in the locked position.

19. The recessed light fixture of claim 17, wherein the first bracket is slidably receivable in the second bracket.

20. The recessed light fixture of claim 17, wherein the second bracket is slidably receivable in the first bracket.

21. The recessed light fixture of claim 17, wherein the side wall is substantially cylindrical.

22. The recessed light fixture of claim 17, wherein at least one of said first and second brackets includes a plurality of graduations.

* * * * *